US005498218A

United States Patent [19]

Proctor et al.

[11] Patent Number: 5,498,218

[45] Date of Patent: Mar. 12, 1996

[54] NECK EXERCISING METHOD

[76] Inventors: Richard I. Proctor, 2175 Danberry, San Rafael, Calif. 94903; Robert Fuller, 885 Gravenstein Hwy. North, Sebastopol, Calif. 95472

[21] Appl. No.: 288,547

[22] Filed: Aug. 10, 1994

[51] Int. Cl.[6] ..... A63B 23/025

[52] U.S. Cl. ..... 482/10; 482/907

[58] Field of Search ..... 482/10, 907, 148

[56] References Cited

U.S. PATENT DOCUMENTS

| | | | |
|---|---|---|---|
| 4,219,193 | 8/1980 | Newman | 482/10 |
| 5,162,027 | 11/1992 | Robinson | 482/10 |
| 5,295,949 | 3/1994 | Hathaway | 482/10 |

FOREIGN PATENT DOCUMENTS

| | | | |
|---|---|---|---|
| 0559138 | 9/1923 | France | 482/10 |

*Primary Examiner*—Lynne A. Reichard
*Attorney, Agent, or Firm*—Thomas M. Freiburger

[57] ABSTRACT

A neck exercising and manipulating device, for stimulating the range of motion of the intervertebral joints of the neck in several directions is in the form of a strap with loops at each end for gripping in the hands. In the middle of the strap is a padded central portion with a high friction surface on one side, for engaging against the back of the neck at various levels depending on the joints to be stimulated. A series of different stimulating exercises are disclosed, for improving the range of motion and comfort of the cervical spine as well as other exercises.

7 Claims, 8 Drawing Sheets

NECK EXERCISING METHOD

BACKGROUND OF THE INVENTION

The invention is concerned with spinal health and comfort and a device for use by a person to stimulate and exercise the cervical spine and joints through several different ranges of motion.

For many persons the neck is subjected to stress and trauma repeatedly. In stressful work situations neck pains often develop, relatively mild injuries can cause long term neck pain, irregular sleeping positions or an improper pillow can cause aches in the neck, and bad posture can contribute to neck problems. Chiropractors and physical therapists often can give neck patients considerable relief and can generally improve the health and range of motion of the neck through manipulations, exercise and physical therapy.

Until the present invention, there has not been a relatively simple, easily used device that can be operated by the patient himself to stimulate the neck intervertebral ranges of motion in different directions, to improve the rotational and flexion-extension range as well as preventing neck pain through a regular program of exercises.

SUMMARY OF THE INVENTION

A neck exercising device according to the present invention is comprised of a relatively simple strap, with means for gripping the two opposed ends in the user's hands and with a special surface in a central portion of the strap device for engaging against the back of the neck. In a preferred embodiment, the strap device is formed primarily of a high-strength strap having a soft comfortable feel to the touch, and this strap may be woven nylon or other synthetic material. The two ends are preferably formed into loops as handles, with length adjustment by a slider buckle provided at each loop. The woven strap material can advantageously be tubular but flattened into strap-like form, as in a well-known strap used for various purposes.

The unique design of this exercise apparatus employs the flat tubular strap structure with slider buckles at each end of the tubular strap to form adjustable handles. Within the tubular structure of the strap, a strip of foam padding wrapped in plastic is located in the central portion of the strap at approximately equal distances from the ends of the strap, forming an oval soft resilient padding in the central area of the strap. A sewed tubular strip of suede leather is placed over the central portion of the strap and sewed in position, so that the tubular synthetic strap, with foam cushioning inside, is sandwiched between two pieces of leather, one with the suede surface exposed. The suede leather covering around the strap is designed to have a soft feel to the skin and to be resilient, but to make a firm slip-resistant contact with the skin surface of the neck so as to grip and not slip over the surface of the skin. The padded suede leather portion of the strap is designed to be placed against the cervical spine for the purpose of assisting intrinsic range of motion of the cervical spine vertebrae and for general range of motion and exercise of the cervical spine. The padded area of the strap provides a unique pivoting axis for the cervical vertebrae to be individually moved in extension, flexion and rotation planes of motion.

The uniqueness of this apparatus is its specific design for the purpose of actively assisting in the biomechanical intrinsic ranges of motion between the individual vertebrae within the cervical spine, which is initiated by the shape, size, resilience and adherence to the skin of the apparatus as applied by the individual user. This active assistance apparatus has been designed for patients of health professionals working in the field of musculoskeletal disorders to improve the biomechanical and neurophysiological function of the cervical spine.

The use of the neck exercising device necessitates appropriate instructions in the proper use of the apparatus. A number of different exercises for the neck are possible with the device, including flexion, extension, hyperextension exercises, as well as these types of exercises involving rotation of the neck. Further, shoulder rotation and abduction stretching exercises are possible, using the exercising strap device above the head or behind the shoulders. A series of different neck and shoulder exercises are described below, with examples given in the drawings.

It is therefore among the objects and purposes of the invention to provide a neck exercising device which assists a user in self-exercise of the neck or shoulders by facilitating the gentle application of resistance, with the exercising user facilitating these exercises using the hands, resulting in helpful exercise and increase of the range of motion of the cervical spine. These and other objects, advantages and features of the invention will be apparent from the following description of a preferred embodiment, considered along with the accompanying drawings.

DESCRIPTION OF PREFERRED EMBODIMENTS

Figure 1:
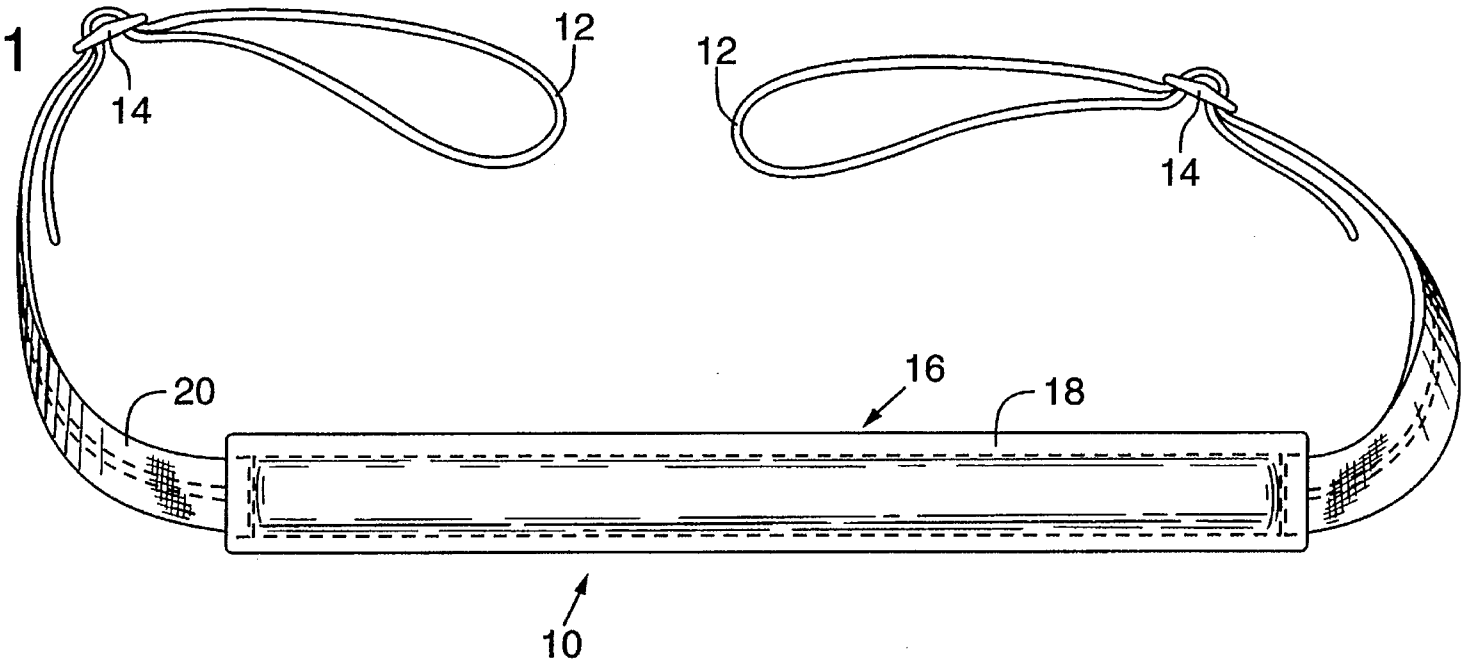
FIG. 1 is a plan or elevation view showing the neck exercising device of the invention.

FIG. 1 shows a neck exercising device 10 of the invention, in the form of a strap having looped ends 12 for receiving the hands of a user, with length adjustment "slider buckle" 14 at the base of each loop to control the overall length of the strap. The strap device includes a central portion 16 which has one side which is soft to the touch, such as of suede leather. FIG. 1 shows the back side 18 of this central portion, the soft side being opposite and not seen in FIG. 1. Both sides of the central portion 16 of the strap can advantageously be of leather, with the inner side (not seen in FIG. 1) being of suede leather, soft to the touch but with a gripping or high friction action on the neck to facilitate the exercises described below.

The strap device 10 can be formed primarily of a woven nylon strap 20 which is formed tubular but flattened as illustrated and without seams. Such a nylon tubular strap is used, for example, in mountain climbing equipment. At each end of the tubular synthetic strap 20 are the hand loops 12; the entire strap length is adjusted by using the slider buckles 14.

In one specific embodiment the flattened-loop strap is about one inch in width (more broadly, ¾ inch to 1½ inch). The central portion may be about 12 inches to 14 inches in length. The strap length extending from each end of the central portion may be about 18 inches to 28 inches long, before looping, or more preferably about 20 inches to 24 inches long.

Figure 2:
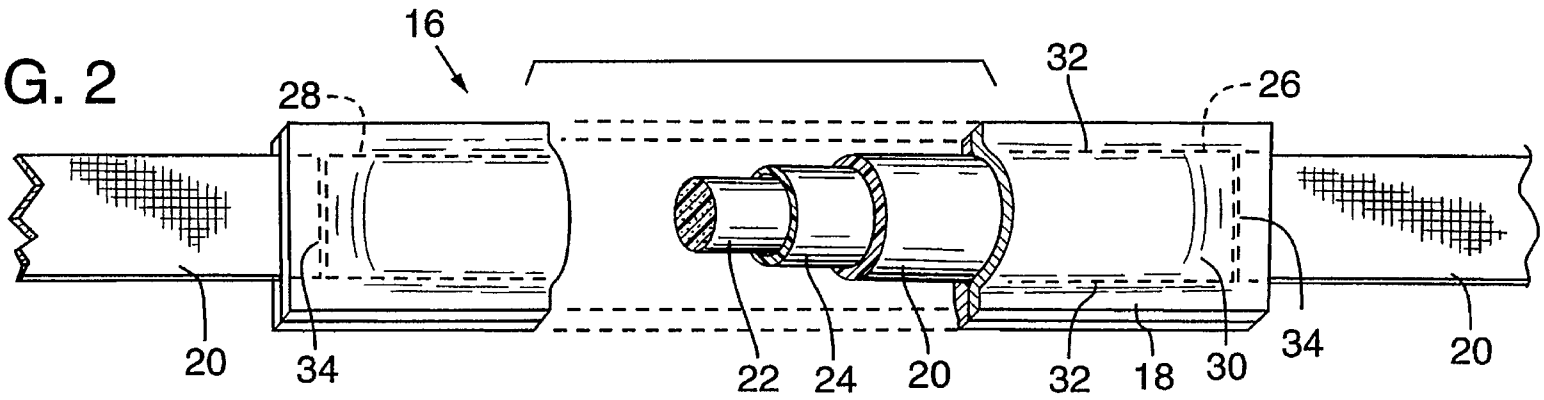
FIG. 2 is an exploded and partially broken away fragmentary view illustrating certain aspects of construction of the exercising device.

FIG. 2 shows in better detail the construction of the central portion 16 of the strap device of the invention. The tubular seamless nylon (or other synthetic) strap 20 has inside it in this central portion a length of elastic foam rubber 22, to provide a cushioned feel in the central portion of the strap device. This foam rubber or similar cushioning material, which normally will have a high friction surface, can be more efficiently inserted into the tubular strap 20 by first encasing it within a lower friction plastic sheath 24, such as of polyethylene or polypropylene. The sheathed foam rubber piece 22 is threaded into the tubular strap 20 from one end, by pulling the piece 22 through using a wire or string. However, another method for inserting the cushioning foam rubber 22, sheathed with the sheath 24, is to form a small slit in the tubular nylon strap 20 near the end of the central portion 16, such as at locations 26 and 28 indicated in FIG. 2, before assembly of the leather piece 18 onto the strap. The sheath cushion can then be fed through using a wire, and it need be pulled only a relatively short distance. The slits in the nylon tube 20 are then covered over with the leather.

FIG. 2 shows the leather piece which is sandwiched over the central portion 16 of the device, including the back side 18 and the inner side 30, which as noted above has a soft but high friction surface, such as suede leather. These two rectangles of leather 18 and 30 are stitched in a pattern generally as shown in FIG. 2, that is, lines of stitching 32 are made in the long direction just outside but adjacent to the edges of the nylon strap 20, and a double line of stitching 34 preferably is made transverse to the length of the strap 20 at each end of the leather pieces, this stitching passing through the nylon tubular strap 20.

The leather pieces 18 and 30 preferably are about 1⅜ inch wide, for a tubular strap width of one inch. This gives a band of contact with the neck, head or body slightly over one inch wide. The leather may be wider or slightly narrower if a different width of tubular strap is used.

Figure 3:
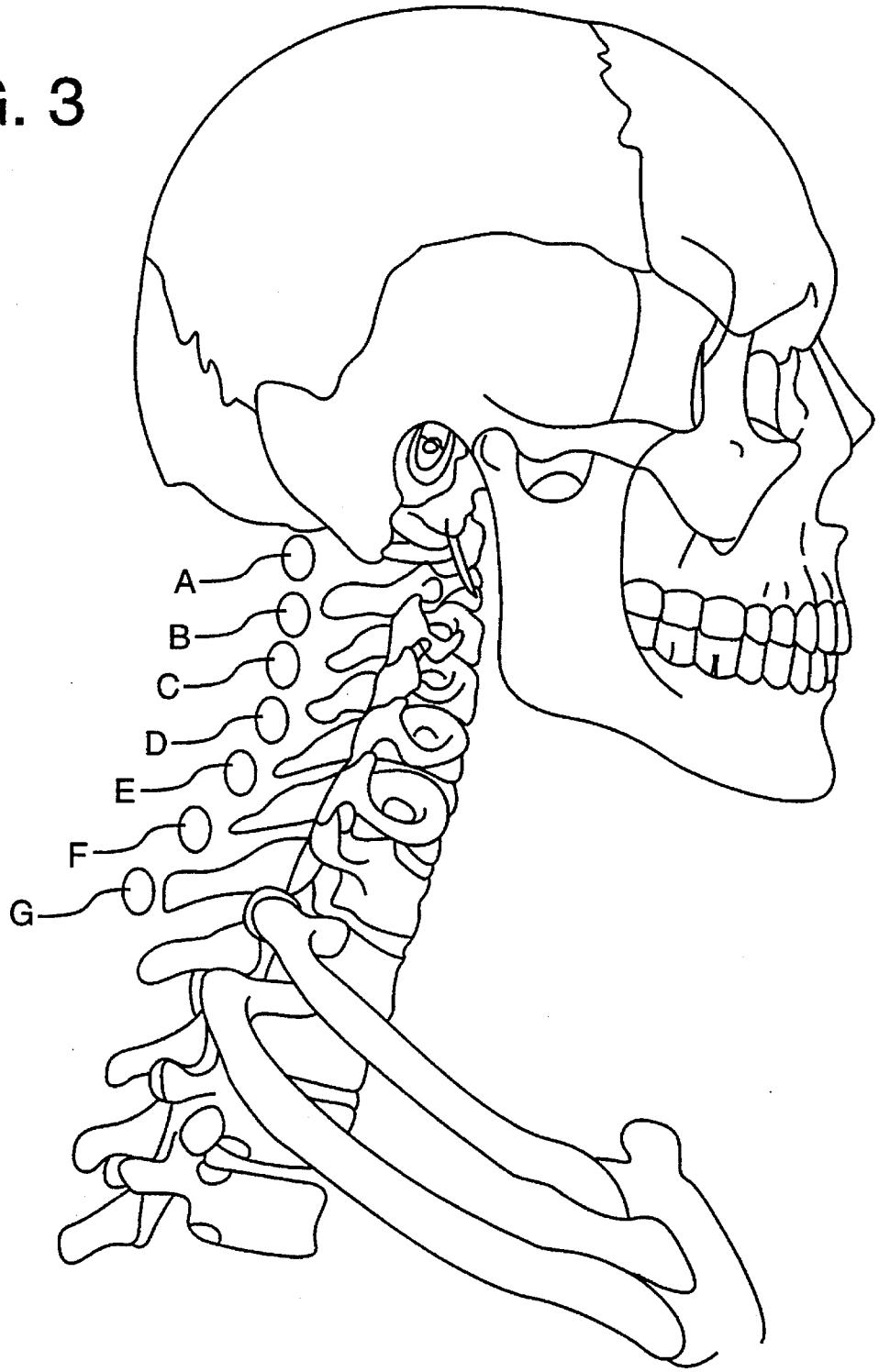
FIG. 3 is a schematic profile view of a portion of a human skeleton, indicating the skull and cervical spine region and showing locations where the exercising device of the invention should be placed for certain exercises.

FIG. 3, indicating the skull and cervical region of the human skull, shows a series of seven points a through g, at which the neck exercising strap device can be positioned for conducting exercises described below in accordance with this invention. These points comprise intervertebral spaces between vertebrae between C1 and C7, and in the case of point a, between the base of the skull and C1.

FIGS. 4A through 16 show various neck exercises including intervertebral range of motion exercises, general cervical spine stretching exercises, and exercises for the cervical spine muscles, as well as a few shoulder range of motion exercises.

For most of these exercises, particularly involving the neck, the soft leather side 30 of the strap device 10 is placed against the back of the neck, generally starting at the base of the skull. The exercises and stretches are to be conducted smoothly and gently, without pulling or jerking excessively to force range of motion. For both intervertebral and stretching exercises, two or three repetitions should be made of each exercise. In the case of neck strengthening exercises, eight to twelve repetitions should be made.

Figure 4A:
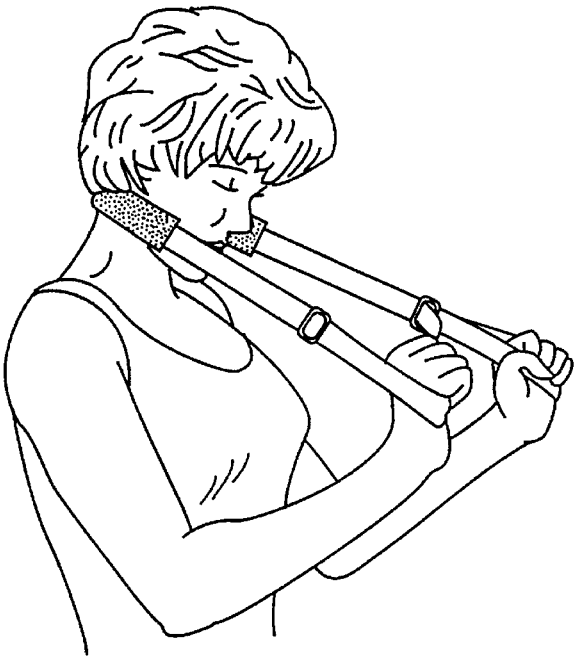
FIG. 4A is a perspective view indicating an exercising user in a position of neck flexion, exercising the neck with the strap of the invention, in a cervical intervertebral range of motion exercise.

In the flexion exercise shown in FIG. 4A, the neck exerciser 10 is placed around the back of the neck and the slack is gently taken out. The head and neck are flexed forward by gently pulling on the strap. The strap is successively moved through the intervertebral positions, preferably starting at the top and working toward the bottom.

Figure 4B:
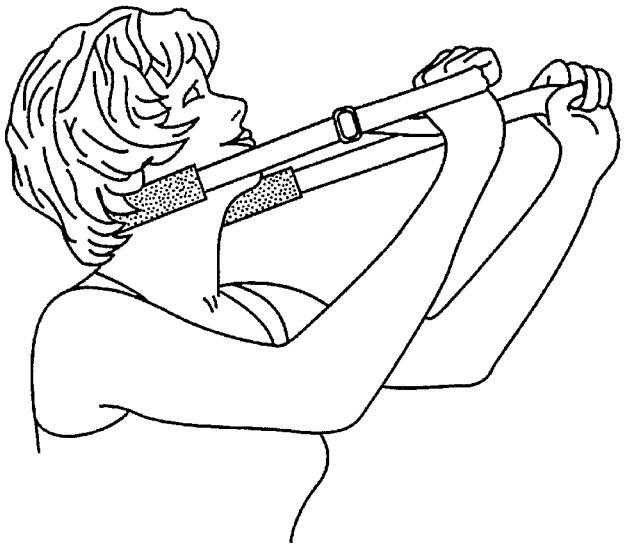
FIG. 4B is a view similar to FIG. 4A, but showing a neck extension exercise using the device of the invention.

A similar intervertebral exercise for extension is shown in FIG. 4B. The strap is placed around the neck as shown. While in a forward flexed position, the user extends the neck to the upright posture, while gently resisting this movement using the strap device. Again, each level should be exercised from the top downward.

Figure 4C:
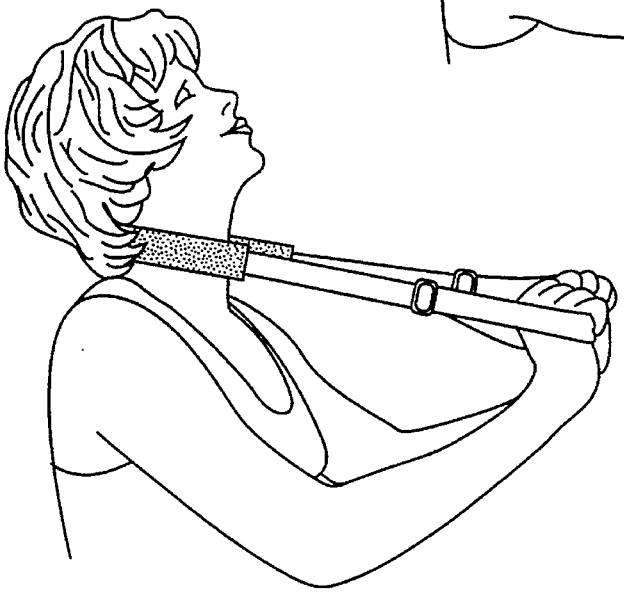
FIG. 4C is a view similar to FIGS. 4A and 4B, but showing a hyper-extension exercise.

FIG. 4C shows a similar intervertebral exercise with hyperextension. The user starts from the upright posture and bends or hyperextends the neck back with a slight resistance to this movement by pulling gently on the exerciser. Repetitions should be made at each intervertebral level. In these exercises the strap forms a fulcrum or bending point for the cervical spine.

Figure 5A:
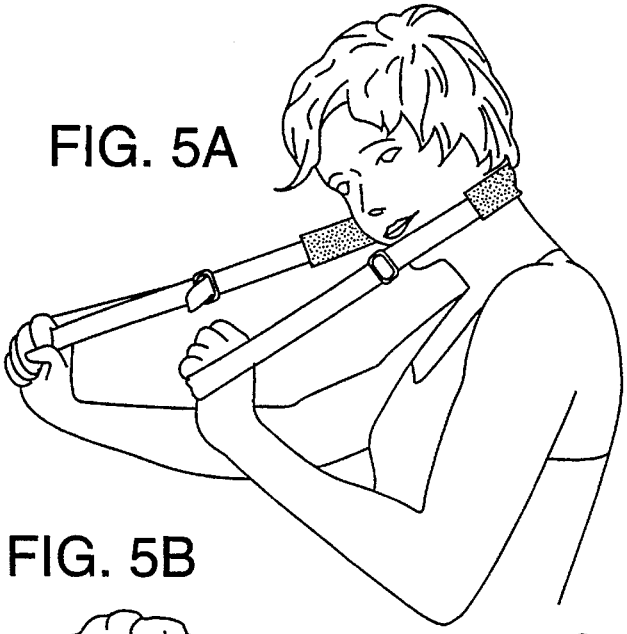
FIG. 5A is another profile/perspective view of a user, employing the exercising device of the invention in a neck exercise involving flexion with rotation, another cervical intervertebral range of motion exercise.
Figure 5B:
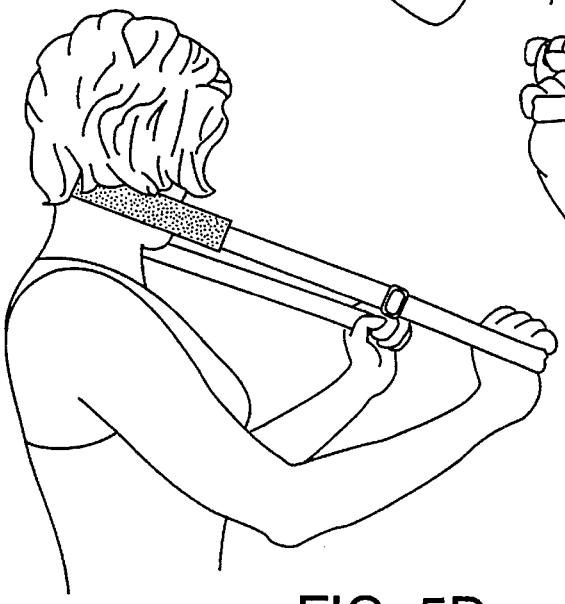
FIG. 5B is a view of the user from a different side, showing the same exercise as in FIG. 5A.

FIGS. 5A and 5B show an intervertebral exercise involving flexion with rotation. The neck exercising device is placed around the back of the neck as shown. While in the forward position illustrated, the user gently rotates the neck by pulling with one hand while applying gentle resistance with the other hand. This exercise is conducted in one direction of rotation, then the other. The strap device is moved from one intervertebral position to the next, and the exercise is repeated. The use of the two hands in opposition, both applying pressure against the neck but one with slightly greater force, helps control the rotation of the neck.

Figure 5C:
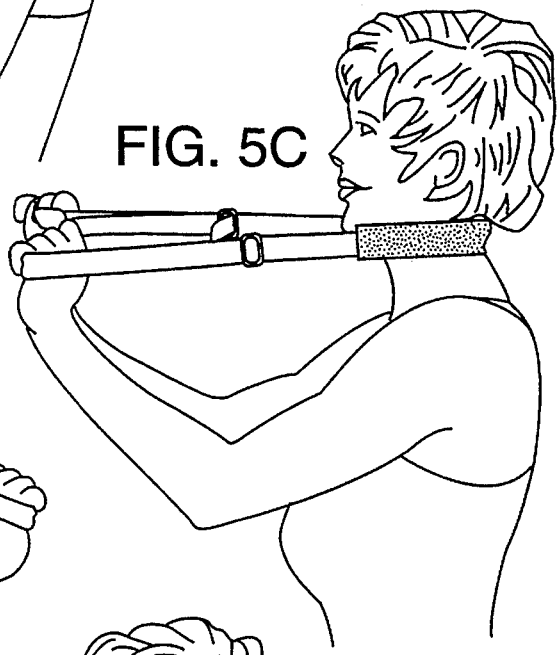
FIG. 5C is a view of the user conducting an exercise involving extension with rotation.
Figure 5D:
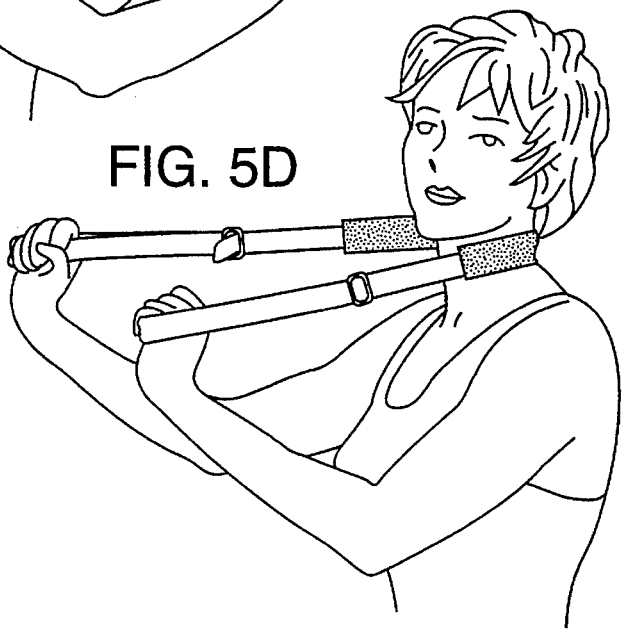
FIG. 5D is a view from another angle, indicating the same exercise as in FIG. 5C.

FIGS. 5C and 5D show a similar intervertebral exercise involving rotation, this time with extension of the neck. In this exercise the movement described relative to FIG. 4B is basically repeated, but it can include gentle rotation of the neck while returning (extending) the neck to the upright position from the forward position. The exercise is repeated in both directions several times for each intervertebral level.

Figure 6A:
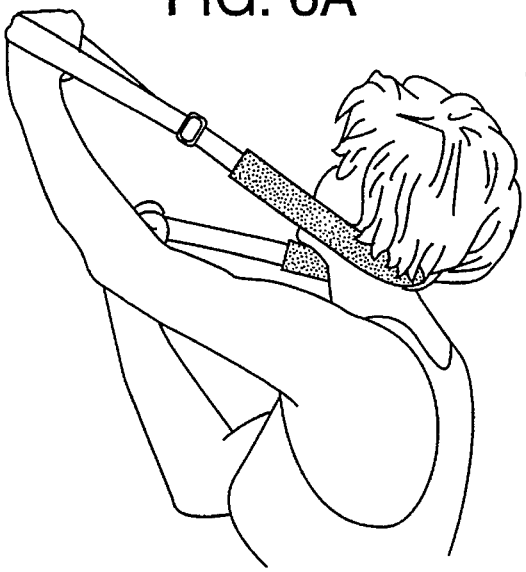
FIG. 6A is another view of the user, in this case carrying out a neck exercise involving hyperextension with rotation, as a further cervical intervertebral range of motion exercise.
Figure 6B:
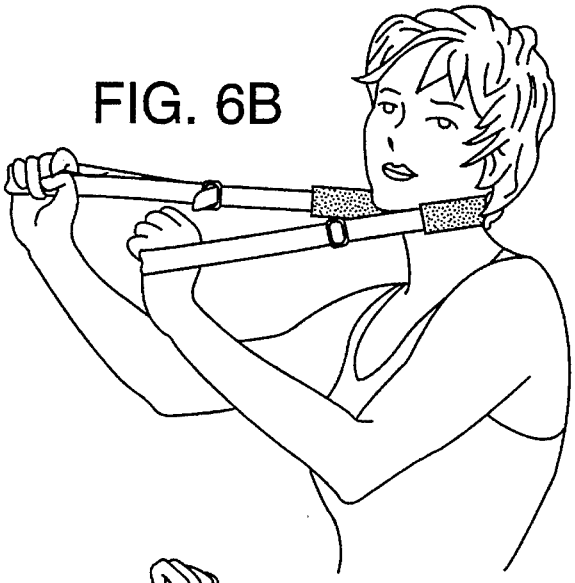
FIG. 6B is a view illustrating the same hyperextension exercise with rotation, from a different angle.

FIGS. 6A and 6B show a similar rotation exercise but in this case with hyperextension. The movement described above is repeated, but as hyperextension of the neck is begun, the gentle rotation is started. Each level is exercised as described above, pulling with the right hand to rotate the spine to the left, while applying gentle resistance with the left hand to control the rotation, and also the reverse. Again, the strap, with pressure pulling on the back of the neck, establishes a fulcrum about which the cervical spine bends in these exercises. The slight bend in the neck with the fulcrum established by the strap better stimulates the increase in the user's range of motion by stimulating the nerves in the intervertebral joints.

Figure 7:
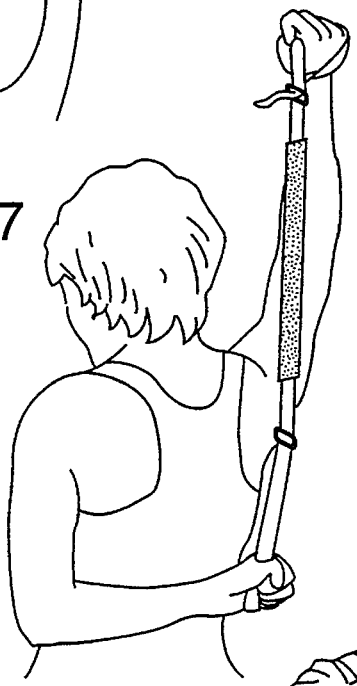
FIG. 7 is a view from the rear of the user, illustrating a shoulder inward rotation exercise using the exercising device of the invention.

FIG. 7 shows a shoulder inward rotation range of motion exercise. The user stands and holds the neck exerciser device with the hands placed through the loops as shown. The arm behind the back is gently stretched by pulling up with the opposite arm above the head as illustrated. The hands are then reversed to stretch the opposite shoulder.

Figure 8:
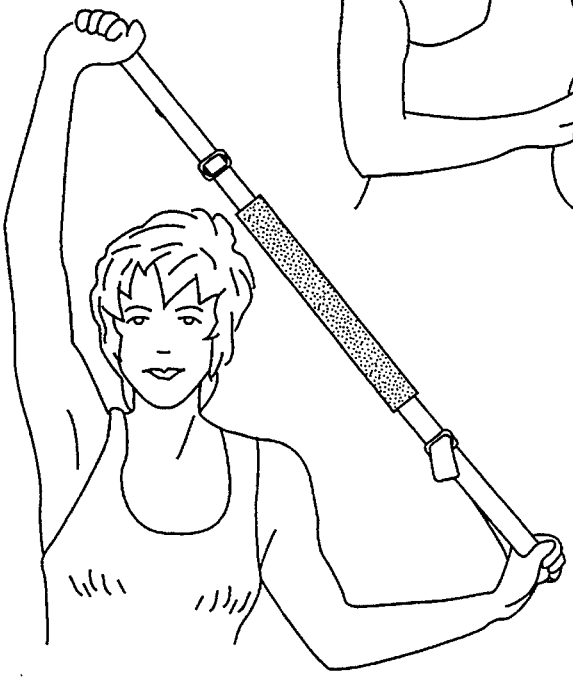
FIG. 8 is a front view of the user, shown using the exercising strap for shoulder abduction stretching.

FIG. 8 shows shoulder abduction stretching as a further shoulder range of motion exercise. The user stands with the hands holding the loops of the exerciser as shown, extending the arms over the head and holding them straight with the arms facing forward. The arms are moved to one side, bringing one arm up to a more vertical overhead position as illustrated and stretching the shoulder in abduction. The opposite shoulder is stretched by reversing this exercise.

Figure 9:
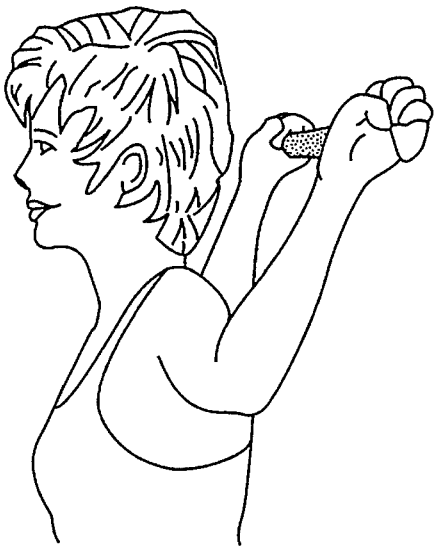
FIG. 9 is a side view of the user, in this case employing the strap in a shoulder external rotation stretch exercise.

In FIG. 9 a shoulder external rotation stretch is illustrated. The ends of the straps are held behind the head as depicted in the figure, and the hands are gently moved backward while keeping the elbows at essentially the same level as the shoulders. This forms an axis of rotation, stretching the inward rotators of the shoulders.

Figure 10A:
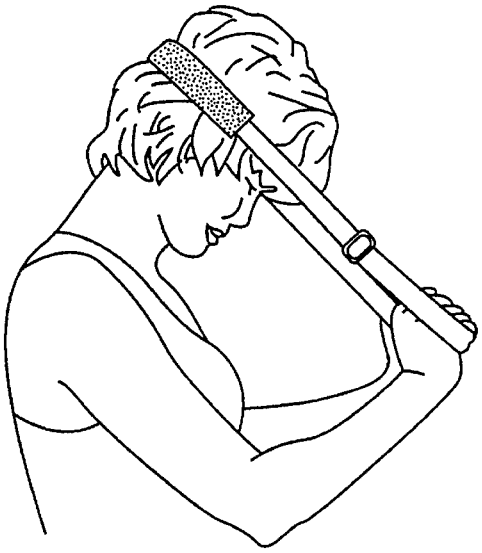
FIGS. 10A and 10B are side views showing the user in an exercise which serves to exercise the muscles of the cervical spine using the exercising strap device of the invention.
Figure 10B:
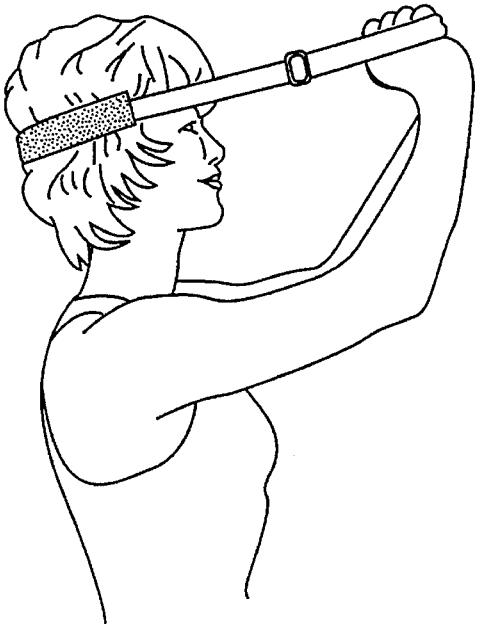

FIGS. 10A and 10B show a neck extension exercise. Starting with the head flexed forward as shown in FIG. 10A, the user places the suede leather side of the neck exerciser device in a balanced position against the back of the head. While holding the arms extended in front of the face as shown, the user tracks with resistance while extending the head upwardly. FIG. 10A shows the starting position while FIG. 10B shows the extended position.

Figure 11A:
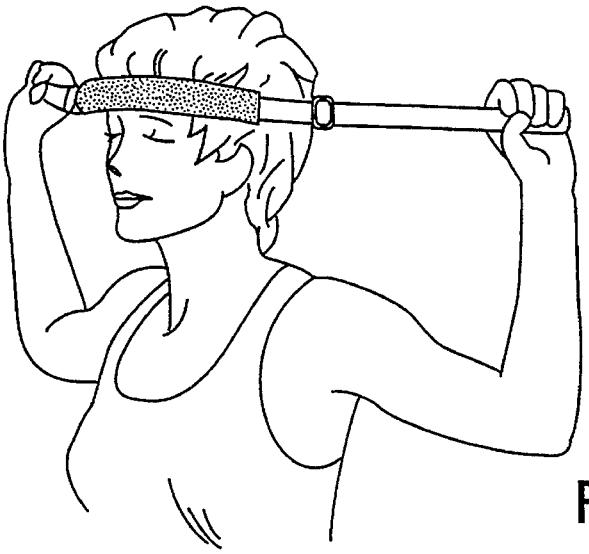
FIGS. 11A and 11B illustrate the user in a forward flexion exercise, wherein the muscles of the neck are exercised through a range of motion.
Figure 11B:
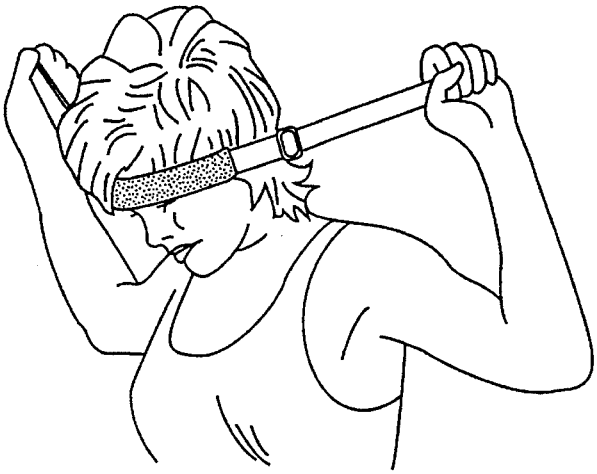

FIGS. 11A and 11B show a forward flexion exercise for the neck. The exercising strap device is placed with the high friction suede leather side against the forehead as shown. The arms are held out to the side at shoulder level as illustrated in FIG. 11A. With the hands the user pushes outward against the ends of the exercising strap device to create resistance against the forehead. Against this resistance the user bends the neck forward toward the chest, keeping the chin tucked in, as illustrated in FIG. 11B.

Figure 12A:
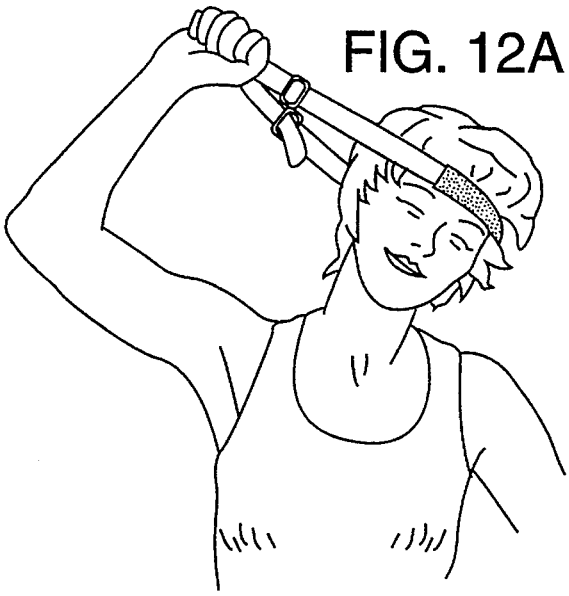
FIGS. 12A and 12B illustrate a lateral neck exercise using the strap device, wherein the muscles of the neck are exercised.
Figure 12B:
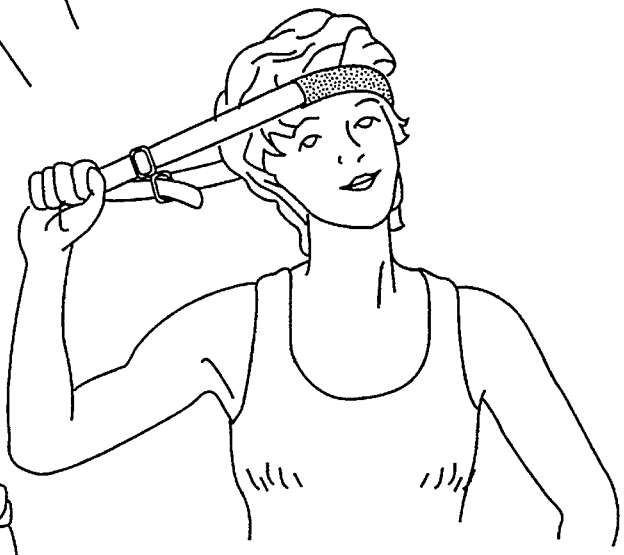

A lateral neck exercise is shown in FIGS. 12A and 12B. In this exercise the user places one hand through both ends of the neck exerciser as shown. The suede leather side of the strap is placed around the head, with the hand above the shoulder. Starting with the head bent toward the same side as the hand holding the neck exerciser, the head is flexed laterally toward the opposite side while resisting this motion using the exercising strap device. This is shown in FIGS. 12A and 12B.

Figure 13A:
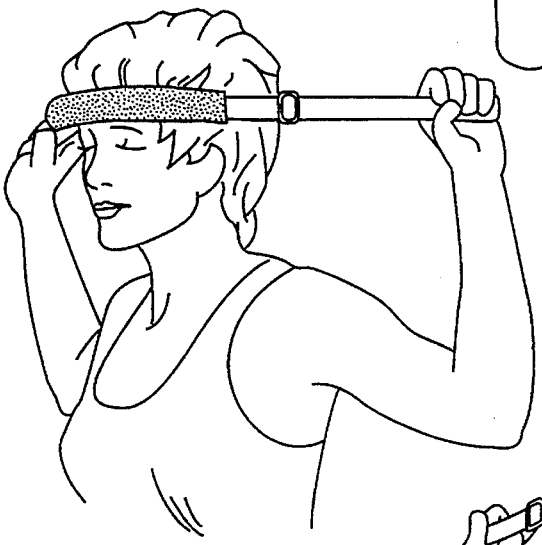
FIGS. 13A and 13B illustrate the use of the strap device in a resistive anterior facet glide neck exercise.
Figure 13B:
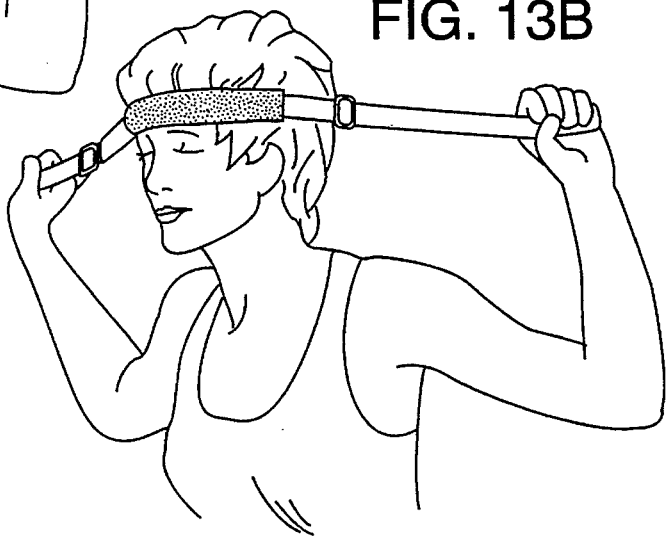

FIGS. 13A and 13B illustrate a user employing the neck exercising strap device of the invention in a resistive anterior facet glide neck exercise. The soft suede leather side of the strap is placed against the forehead as shown. With the hands looped through the ends of the exerciser device, the user pushes outward against the ends to create resistance against the forehead as illustrated in FIG. 11A. The hands should be facing forward. While generating the appropriate resistance while pushing outward with the hands, the forehead is moved straight forward (not a flexing movement), maintaining the face vertical and forward as shown in FIG. 13B.

Figure 14A:
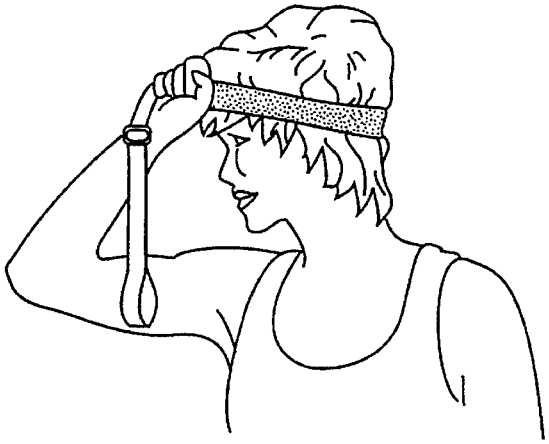
FIGS. 14A and 14B illustrate the use of the device in a neck rotation exercise.
Figure 14B:
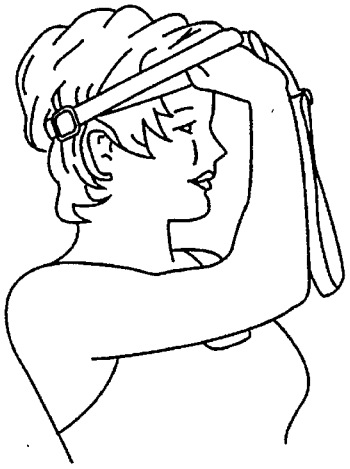

FIGS. 14A and 14B show a neck rotation exercise. The exercising strap device is placed around the head so that all slack is taken off the strap as illustrated in FIG. 14A, gripping using only one loop but not the other as shown. The head is turned to the left while the strap is squeezed with the right hand as in FIG. 14A. While resisting movement with the right hand, the user rotates the head to the opposite side as depicted in FIG. 14B.

Figure 16:
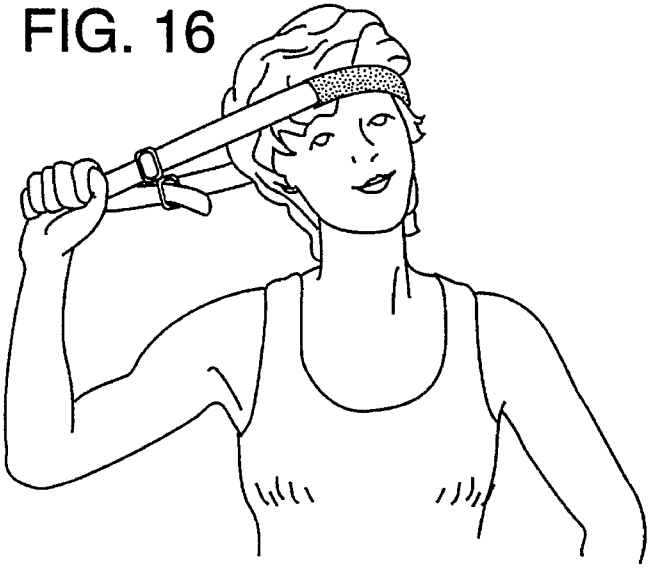
FIG. 16 is a frontal view showing another general neck range of motion exercise, wherein the user employs the strap in a lateral neck stretch exercise.
Figure 15:
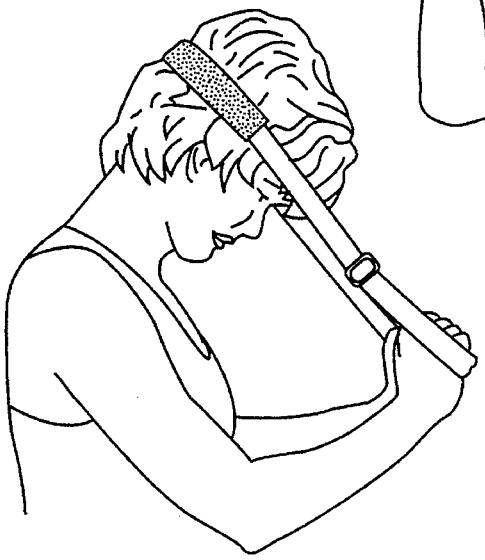
FIG. 15 is a side view showing the use of the device in an exercise for stretching the back of the neck, as a general neck range of motion exercise.

FIGS. 15 and 16 show exercises for general neck range of motion. In FIG. 15 a back of the neck stretch exercise is illustrated. The high friction suede side of the neck exerciser strap device is placed around the back of the head in a balanced position so that it will not slip, as shown in FIG. 15. The head is gently stretched forward and downward as illustrated. The user keeps the chin tucked in throughout the exercise. The neck is returned to the upright position and the exercise is repeated.

In FIG. 16 the user performs a lateral neck stretch exercise. With one hand placed through both end loops of the exercising strap device and with the suede leather side placed against one side of the head as shown, the hand holding the strap is kept above shoulder height. The user gently pulls to one side to achieve the desired stretch. The head is returned to the upright position and the exercise is repeated.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A method used by a human user, for stimulating or increasing the intrinsic range of motion in rotation of the user's neck and relative rotation between adjacent intervertebral joints, comprising:

placing around the back of the neck of the human user, at a selected level of the cervical spine below the base of the skull, a strap with gripping means on each end for gripping by the hands of a user, the length of the strap being such that when placed around the back of the neck the user engages the ends of the strap in two hands with the forearms generally upright, and the strap having a high friction engagement surface in a central portion positioned to engage against the back of the neck, rotating the neck alternately left and right with the guidance and assistance of the strap by alternately pulling one way and then the other with the hands while applying some pressure by the strap against the back of the neck using the hands, to move the neck through the rotational range of motion of the intervertebral joint and to stimulate the intervertebral joint at the left and right extremes of its range of motion.

2. The method of claim 1, further including placing the neck in a position of extension while moving the neck with the assistance of the strap.

3. The method of claim 1, further including placing the neck in a position of hyperextension while supporting the neck and at least part of the weight of the head with the strap and moving the neck through the intrinsic range of motion.

4. The method of claim 1, including placing the neck in a position of flexion while moving the neck through intervertebral rotation with the guidance and assistance of the strap.

5. The method of claim 1, including repetition of the steps of rotation in claim 1 with the strap placed at different levels on the neck, to engage at different intervertebral joints in the cervical spine.

6. The method of claim 1, wherein the high-friction surface of the strap applied against the back of the neck has a skin contact width bearing against the neck of about one inch and has a padded resiliency for engaging against the neck.

7. The method of claim 6, wherein the resiliency of the strap in the central portion is formed by a generally tubular cross-sectional shape of the central portion of the strap, so that pressure against the neck is greater at a central level of the strap as opposed to upper and lower extremities of the strap.

* * * * *